US005103996A

United States Patent [19]

McGarvey

[11] Patent Number: 5,103,996

[45] Date of Patent: * Apr. 14, 1992

[54] FIRE RESISTANT TANK CONSTRUCTION

[75] Inventor: David C. McGarvey, San Gabriel, Calif.

[73] Assignee: LRS, Inc., South El Monte, Calif.

[ * ] Notice: The portion of the term of this patent subsequent to May 7, 2008 has been disclaimed.

[21] Appl. No.: 585,958

[22] Filed: Sep. 21, 1990

Related U.S. Application Data

[63] Continuation-in-part of Ser. No. 331,548, Mar. 31, 1989, Pat. No. 5,012,949.

[51] Int. Cl.[5] ..... B65D 90/06; B65D 90/22

[52] U.S. Cl. ..... 220/455; 220/565; 220/469; 220/484

[58] Field of Search ..... 220/484, 453, 454, 455, 220/456, 468, 469; 428/920, 921

[56] References Cited

U.S. PATENT DOCUMENTS

| | | |
|---|---|---|
| 810,237 | 1/1906 | Wadsworth . |
| 1,114,019 | 10/1914 | Morris . |
| 1,273,195 | 7/1918 | Snyder . |
| 1,652,765 | 4/1927 | Ratzenstein . |
| 1,724,582 | 8/1929 | Hart . |
| 2,460,054 | 1/1949 | Wiggins . |
| 2,558,694 | 6/1951 | Speig . |
| 2,772,834 | 12/1956 | Swenson et al. . |
| 2,858,136 | 10/1958 | Rind . |
| 2,860,807 | 11/1958 | Morton . |
| 2,864,527 | 12/1958 | Altman et al. . |
| 2,869,751 | 1/1959 | Klope et al. . |
| 2,931,211 | 4/1960 | McCullough . |
| 3,595,424 | 7/1971 | Jackson . |
| 3,666,132 | 5/1972 | Yamamoto et al. . |
| 3,702,592 | 11/1972 | Gamble . |
| 3,827,455 | 8/1974 | Lee . |
| 3,941,272 | 3/1976 | McLaughlin . |
| 3,952,907 | 4/1976 | Ogden et al. . |
| 3,967,256 | 6/1976 | Galatis . |
| 3,969,563 | 7/1976 | Hollis, Sr. . |
| 4,376,489 | 3/1983 | Clemens . |
| 4,651,893 | 3/1987 | Mooney . |
| 4,685,327 | 8/1987 | Sharp . |
| 4,697,618 | 10/1987 | Youtt et al. . |
| 4,815,621 | 3/1989 | Bartis . |
| 4,826,644 | 5/1989 | Lindquist et al. . |
| 4,844,287 | 7/1989 | Long . |
| 4,890,983 | 1/1990 | Solomon et al. . |
| 4,989,750 | 2/1992 | McGarvey . |

OTHER PUBLICATIONS

Uniform Fire Code, 1985 Ed., pp. 203-278.
Reliance Tank Sales Materials (undated)—price list date Jan. 20, 1989.
Agape Tank Sales Materials (dated by postmark Jun. 7, 1989).
Doehrman, Inc. facsimile dated May 9, 1989.
Safe-T-Tank Corp. sales materials dated 1987—Sales materials from Air Boy (Jun. 1988)—advertisement dated Feb. 1987 from Keesee, "Lube Cube" sales materials dated Jul. 1, 1988.
UL 142 Standard for Safety, Steel Aboveground Tanks (1987).
Husky 1030 Double Diaphragm Pump (1987) instructions and parts list.
"Oil Evacuation System", Aro Corp. (1982).
"1/2 Waste Oil Evacuation System" (drawing dated Mar. 15, 1987).
"Aro Air Operated Diaphragm Pumps" (1986).
"Aro Lubrication Equipment" (1989) pp. 31 and 33.
Cla-val Co. flat control parts list (1977).

*Primary Examiner*—Joseph Man-Fu Moy
*Attorney, Agent, or Firm*—William W. Haefliger

[57] ABSTRACT

A fire resistant tank apparatus adapted for transportation and for installation above-ground to receive and dispense a liquid hydrocarbon or hydrocarbons, or the like, and includes a metallic tank having a lightweight wall structure, including an upright side wall or walls, a top wall and bottom wall; first port structure on the top wall defining access porting to the tank interiorp; second support structure beneath the bottom wall to support the tank at an installation site; and fire resistant material consisting essentially of a mixture of vermiculite and Portland cement applied as a coating to the outer side or sides of the tank walls, and hardened in situ to define a relatively lightweight shell enclosing the tank; the shell having thickness between about ¼ inch and 1 inch.

35 Claims, 4 Drawing Sheets

FIG. 1.
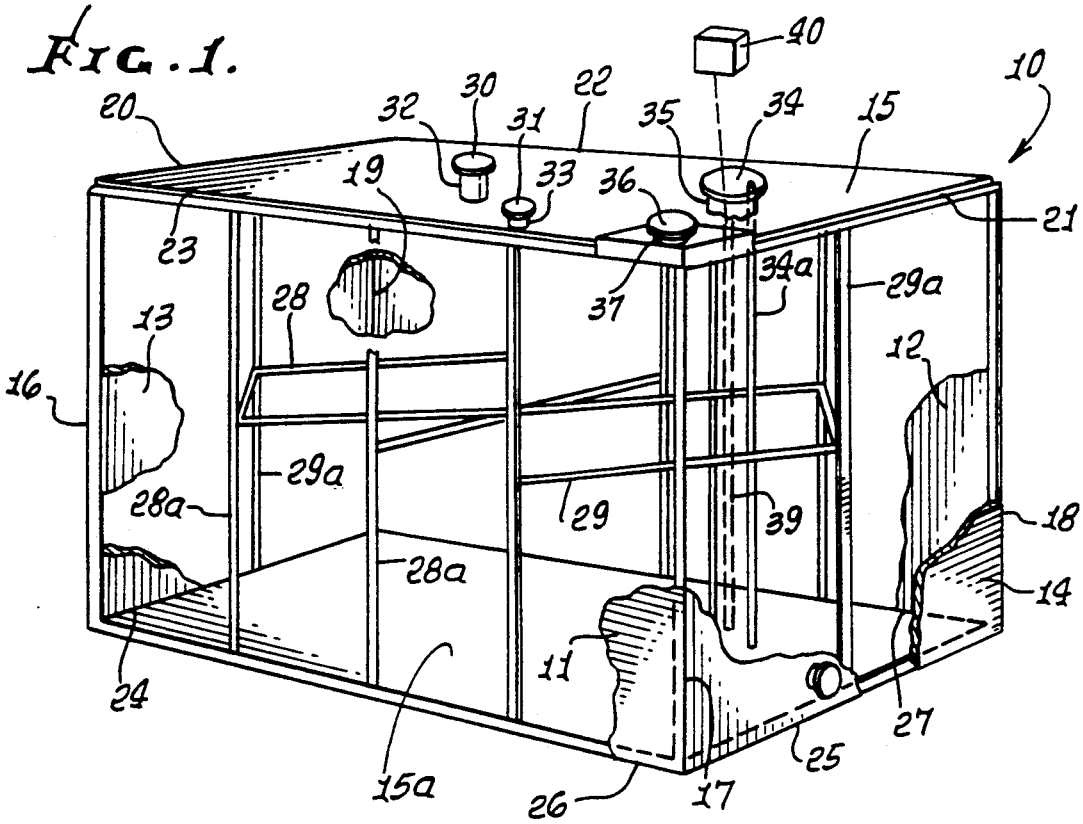
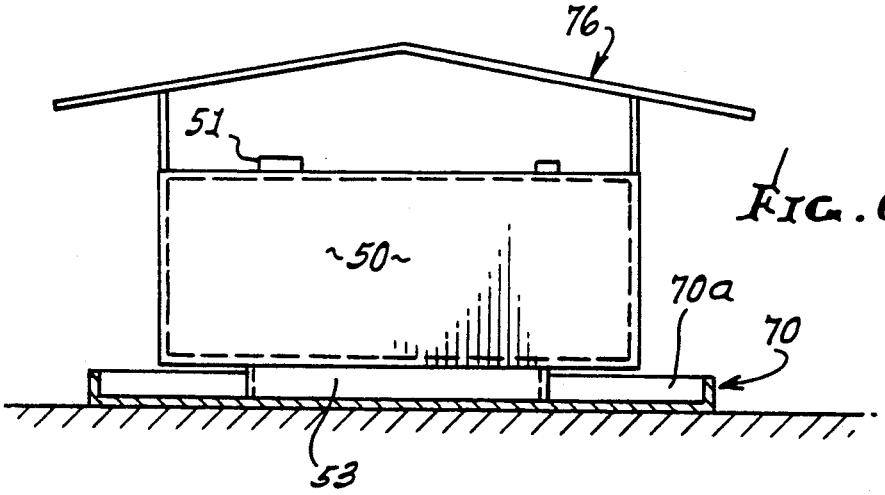
FIG. 6.
FIG. 7.
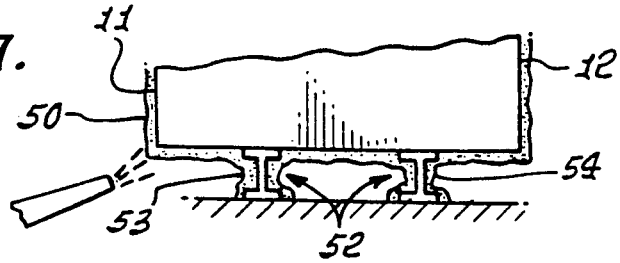

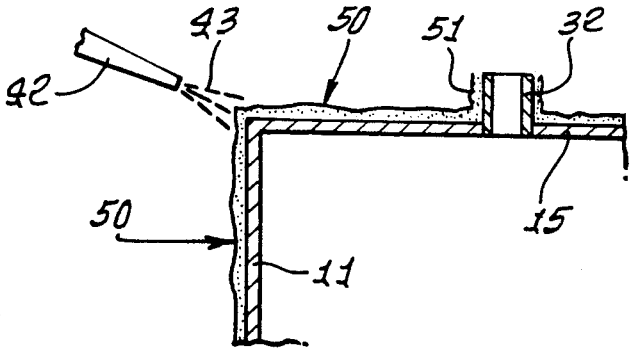
FIG. 2.
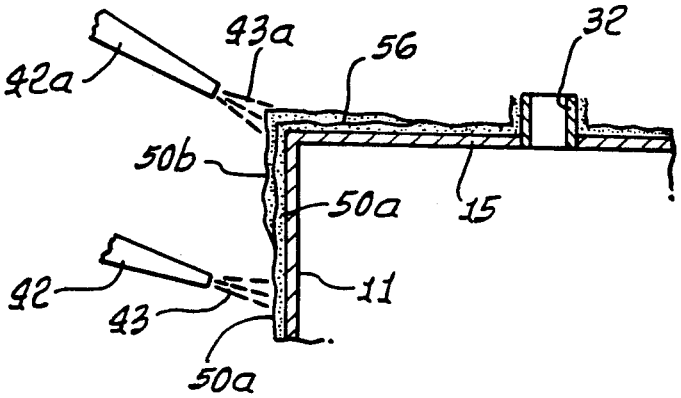
FIG. 3.
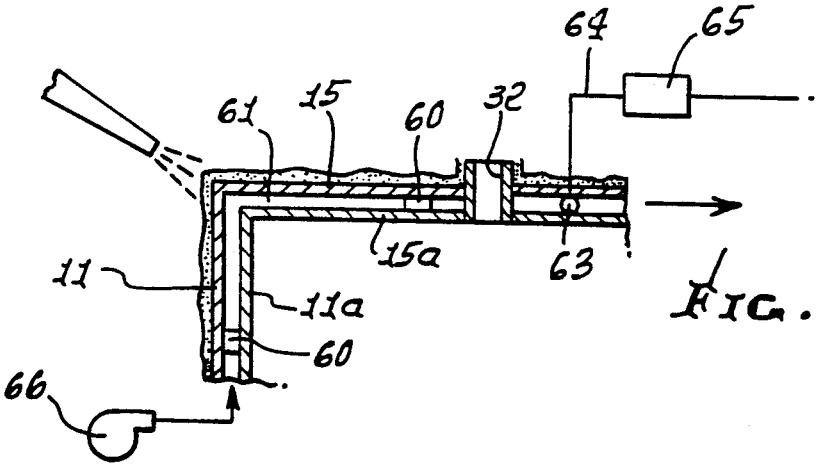
FIG. 4.
FIG. 5.
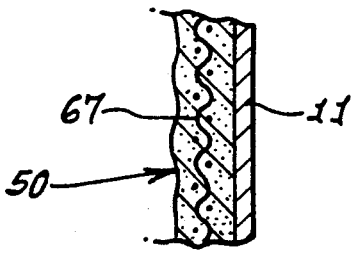
FIG. 5a.
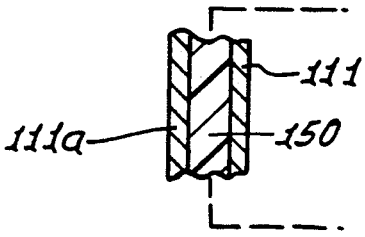

FIRE RESISTANT TANK CONSTRUCTION

This application is a continuation-in-part of Ser. No. 331,548 filed Mar. 31, 1989.

BACKGROUND OF THE INVENTION

This invention relates generally to tanks for flammable and combustible liquids, and more particularly concerns methods and means for making such tanks fire resistant in above-ground installation environments.

Tanks holding flammable or combustible liquids, such as new and used hydrocarbon products, if installed above ground, can be dangerous if not "fireproofed", i.e., made "fire resistant". For example, if the tanks leak flammable liquid, a fire danger will exist. Fire can weaken the lightweight tank walls and lead to tank collapse and spillage of tank contents.

In the past, such tanks were enclosed in concrete and transported to installation sites; however, the concrete is subject to cracking, which then can allow leakage to the exterior of flammable liquid leaking from the tank itself. Also, the concrete-enclosed tank is extremely heavy and difficult to transport. There is need for method and means to make such tanks fireproof and leakproof in such a way that a relatively lightweight unit is provided, for ease of transportation and installation, and subsequent safety.

SUMMARY OF THE INVENTION

It is a major object of the invention to provide method and means meeting the above need. Basically, the method of providing a fire resistant tank apparatus, for flammable liquid, includes the steps:

a) providing a metallic tank having upright side wall means, a top wall and a bottom wall, b) providing first means on the top wall defining access porting to the tank interior, c) providing second means beneath the bottom wall to support the tank at an installation site, d) applying fire resistant material onto the tank walls, and allowing the the material to harden in situ to form a relatively lightweight shell enclosing the tank, the material applied closely adjacent the first and second means, e) the application step continued to provide shell thickness between about ¼ and 1 inch.

As will be seen, the material typically consists essentially of an aqueous admixture of Portland cement and vermiculite in as-applied state.

Alternatively, or in addition to the above, vermiculite may be filled into space between outer and inner tank walls.

As will be seen, the application step is typically carried out by spraying said material:

i) to form a first thin layer of coating material extending adjacent the tank walls, the first layer allowed to harden, the first layer having an outer surface;

ii) and subsequently to form a second coating layer extending into contact with the outer surface of the first layer, the second layer then allowed to harden.

Thus, multiple shells of coating material are formed, to permit flexing and installation impacts without cracking.

The sprayable and hardenable fire resistant material typically consists essentially of an aqueous admixture of about 80% cement and about 20% vermiculite, enough water being used to enable spraying of the mix.

A further safety feature is the construction of the tank walls themselves to have inner and outer sub-walls defining a gap therebetween, and the admixture may be sprayed onto one or both such walls, to form a shell or shells. Vermiculite may be filled into the space between the walls and shells.

In its apparatus aspects, the fire resistant tank apparatus (to hold and dispense flammable liquid such as hydrocarbon fuel, or the like) comprises:

a) a metallic tank having upright side wall means, a top wall and a bottom wall, b) first means on the top wall defining access porting to the tank interior, c) second means beneath the bottom wall to support the tank at an installation site, d) the wall means including inner and outer sub-walls defining a gap therebetween, e) and fire resistant material applied to the wall means and located in the gap to effectively define a shell enclosing the inner sub-wall, f) the shell having thickness between about ¼ inch and 1 inch, g) the tank walls having thickness between about ¼ inch and 1 inch.

As stated, the fire resistant material typically may consist essentially of aqueous mixture of vermiculite and Portland cement applied as a coating to the outer side or sides of the tank walls, and hardened in situ to define a relatively lightweight shell enclosing the tank.

These and other objects and advantages of the invention, as well as the details of an illustrative embodiment, will be more fully understood from the following specification and drawings, in which:

DRAWING DESCRIPTION

FIG. 1 is a perspective view of a metallic tank, prior to spraying of fie resistant material onto the tank walls;

FIG. 2 is a fragmentary section showing spray-on of fireproof coating material;

FIG. 3 is a view like FIG. 2, but showing spray-on of multiple layers of the fireproof coating material;

FIG. 4 is a view like FIG. 2, but showing a multi-wall tank construction;

FIG. 5 is a fragmentary section showing use of mesh embedded in the sprayed on fireproofing material;

Figure 8:
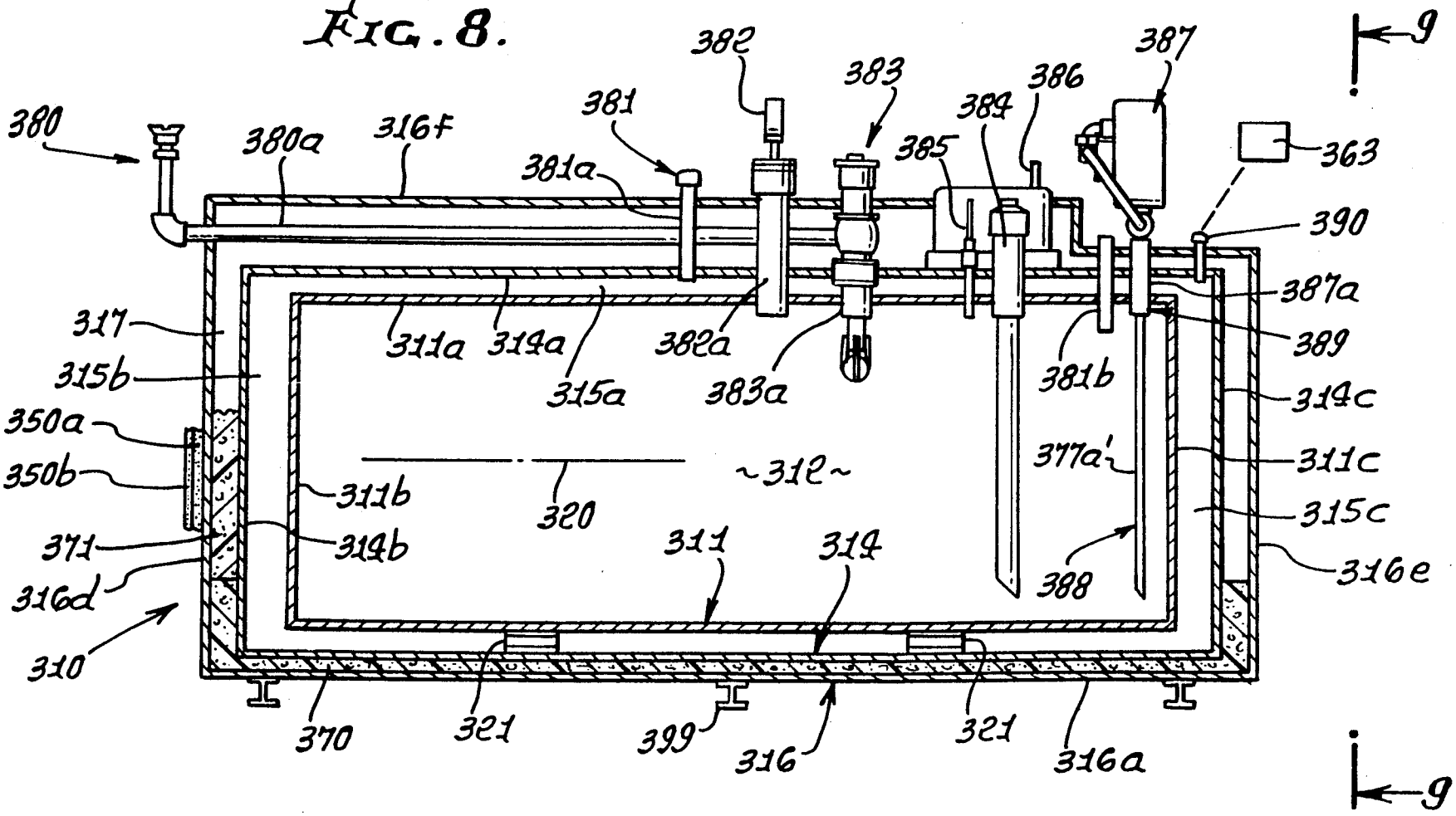
Figure 9:
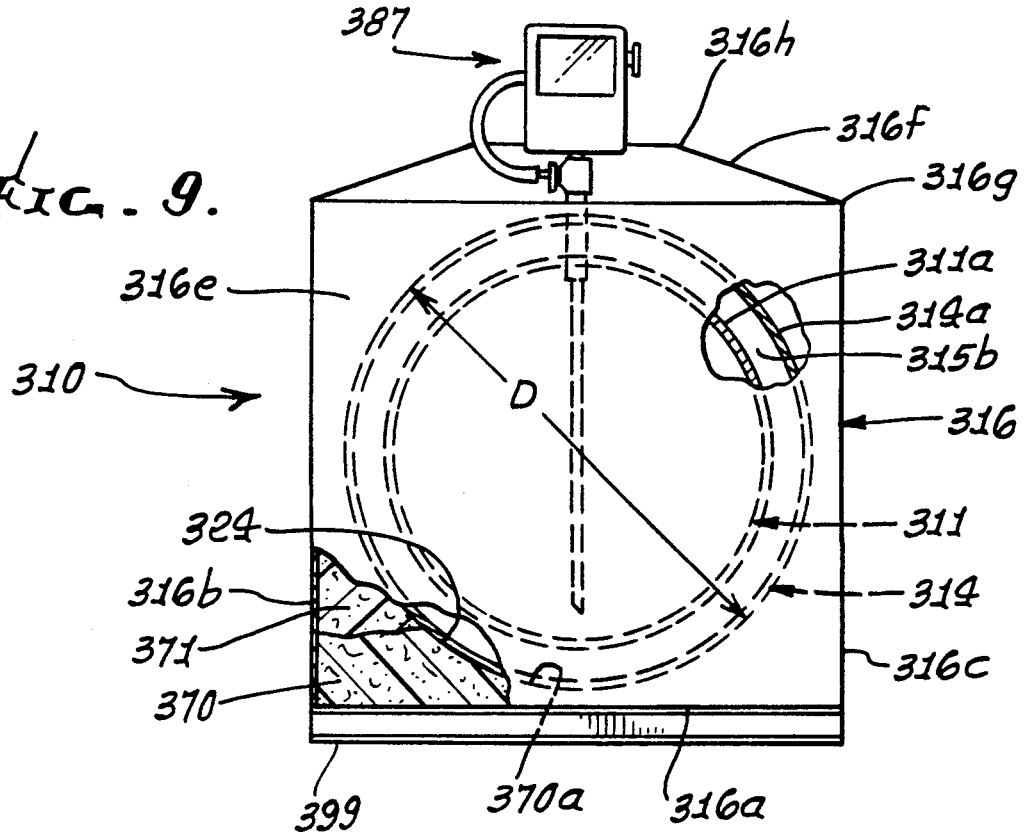

FIG. **5*a*** is a fragmentary section showing a filled gap between a double wall tank structure;

FIG. 6 is a side elevation showing the fireproofed tank supported in a shallow receptacle at an installation site;

FIG. 7 is an end view of a tank, showing support means being sprayed with fire-resistant material;

FIG. 8 is a view, in section, of a modified triple-hull tank apparatus;

FIG. 9 is an end view of the FIG. 8 apparatus; and

Figure 10:
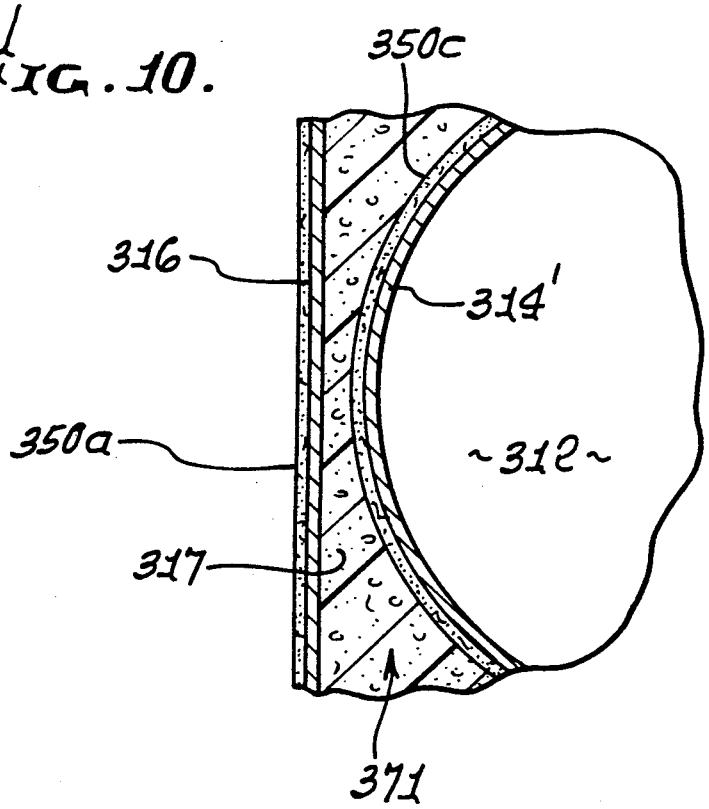

FIG. 10 is an enlarged section.

DETAILED DESCRIPTION

In FIG. 1, a tank 10 to be made fire resistant, includes upright front and rear side walls 11 and 12, upright end walls 13 and 14, and horizontal top and bottom walls 15 and **15*a*. Such walls may consist of steel and be less than one inch thick, for lightweight tank construction enhancing portability, for installation above ground at different sites, as desired. Typically, the steel walls are about 10 gauge (⅛ to ¼ inch thick). The tank length between walls 13 and 14 may typically be about 10–15 feet. The walls are typically interconnected by welds at their junctions, as at 16–19, 20–23, and 24–27. Internal braces may be provided, as at 28–29, and vertical braces at 28a and 29a**. The tank side walls may define a cylindrical tank, which may be considered to have side and end walls integrated into a cylindrical wall.

Located in the top wall or walls are bungs 30 and 31 which are removable from upright stub pipes 32 and 33, respectively. A pipe cover 34 is rearwardly attached to the top of the stub pipe 35; and a vent cover 36 is attached to stub pipe 37. The upright stub pipes (providing means to define access porting to the tank interior) are welded to the top wall and provide access to the tank interior via ports in the top wall. Dipsticks (as at 34a) may thus be inserted into the tank to measure the level of liquid hydrocarbon, i.e., flammable or combustible liquid (such as fuel) in the tank. Monitor means 39 may be installed in the tank via one of the access ports to sense liquid level and transmit corresponding electrical signals to external apparatus 40 that registers the liquid level for ready viewing.

Referring to FIG. 2, it shows a nozzle 42 spraying fire resistant synthetic resinous material at 43 onto the tank walls, to a thickness between about ¼ inch and 1 inch. That material, which may typically be epoxide resin based, is allowed to harden in situ, to form a relatively lightweight shell 50 enclosing and adhering to the metallic tank, on all sides, ends, and top and bottom. The material is sprayed closely adjacent, and typically onto and about the stub pipe, as at 51, i.e. adherent to pipe 32, at the top wall, and is also sprayed closely adjacent (i.e., onto and about the sides of) support means such as the supports 52 integral with the bottom wall. See shell layers 53 and 54 on the sides of supports 52, in FIG. 7. The material forming shell 50 may be otherwise applied to the tank wall or walls; however, spraying is preferred as it allows troweling of the material, for finishing.

If the shell thickness is greater than about 1 inch, the total unit weight becomes too great for ease of transport; and if the shell thickness is less than about ¼ inch, the desired "fireproofing" is reduced to an unacceptable level—i.e, fireproofing effect becomes too small.

In order that the material 43 being sprayed on may cling to the upright metal walls without sagging out of position, and also to have optimum fireproofing effect, it has typically an epoxide resin base, and chars when exposed to flame. One example is the sprayable two component intumescent epoxy fireproofing system (CHARTEK) (liquid resin and hardener, mixed with methylene chloride, or 1,1,1,-trichloroethane) supplied by Avco Specialty Materials, Lowell, Mass.

FIG. 3 shows a nozzle 42 spraying fireproofing material at 43 onto the tank wall 11 to form a first layer 50a, which is allowed to harden or cure, in situ; and a second nozzle 42a (or the same nozzle 42) is then used to spray fireproofing material 43a onto the layer 50a, to form a second layer 50b, which is allowed to harden, in situ. The combination of shells or layers 50a and 50b form the composite shell 50 having thickness between ¼ and 1 inch. Dual shells are defined, or even more shells in the composite, provide an even stronger, more leak resistant and fire resistant unit. An interface between the sub-shells 50a and 50b appears at 56 and each applied coat is troweled before application of the next coat.

Prior to spraying the first layer 50a into the tank walls, the latter are preferably sand blasted for cleaning purposes; and a primer coat is applied to the raw metal surface to resist rust formation. The primer coat may, for example, consist of polyamide epoxy resin, such as AMERON 71, SUBOX A8051, or VAL-CHEM 13-R-56, or ethyl silicate inorganic zinc (such as DIMETCOTE 6).

FIG. 4 shows a tank consisting of outer tank walls 11–16, as referred to above, and inner metallic walls 11a–16a, as shown. Walls 11a–16a are spaced from the respective walls 11–16, as by local spacers 60, to provide a gap or space 61 between the walls. Any fluid leaking from the tank interior via the inner wall passes first to the gap 61, and may be detected as by a sensor 63 sensing volatile gases emitted by the flammable hydrocarbon. The sensor or detector is connected at 64 to an external monitoring device 65, as shown. Flow of air or flammable liquid in the gap may be induced, as by a blower 66.

FIG. 5 shows a strengthening mesh 67, for example made of wire, embedded in the shell 50 forward about the tank walls.

FIG. 5a shows the tank wall means (side wall or walls and/or top wall and/or bottom wall, as referred to) to include for example inner and outer sub-walls 111 and 111a. A gap between the sub-walls contains fire resistant material 150 (as for example of the type described above) to effectively define a shell including the inner sub-wall 111, the shell thickness between ¼ inch and 1 inch. The shell may otherwise consist of an insulative sheet such as styrofoam or flowable fireproof material, such as VERMICULITE. Broken lines 115 and 116 show extensions of such structure to the top and bottom wall construction of the tank.

Properties of the "CHARTEK" fireproofing system referred to above are as follows:

TABLE I

CHARTEK MECHANICAL PROPERTIES

| Property | ASTM Reference | Value | Conditions |
|---|---|---|---|
| Tensile Strength | D638 | 2750 psi<br>$19.0 \times 10^6$ PA | Room Temp. |
| Modulus | | $3.42 \times 10^5$ psi<br>$2.36 \times 10^9$ PA | Room Temp. |
| Compressive Strength | D659 | 6342 psi<br>$43.7 \times 10^6$ PA | Room Temp. |
| Modulus | | $1.89 \times 10^5$ psi<br>$1.3 \times 10^9$ PA | Room Temp. |
| Impact Strength (unsupported, unmeshed) | D256 | 0.42 ft lbs/in<br>0.22 J/cm<br>0.71 ft lbs/in<br>0.38 J/cm | Room Temp. notched<br>Room Temp. unnotched |
| Flexural Strength | D790 | 4290 psi<br>$29.6 \times 10^6$ PA | Room Temp. |
| Modulus | | $3.32 \times 10^5$ psi<br>$2.3 \times 10^9$ PA | Room Temp. |
| Hardness | Shore D | 83 | D Scale |
| Bond Strength | D1002 | 1578 psi<br>$10.9 \times 10^9$ PA | Primed, room temp. |

TABLE II

PHYSICAL PROPERTIES

| Property | ASTM Reference | Value | Conditions |
|---|---|---|---|
| Density | D792 | 79 lbs/ft$^3$<br>1.27 g/cc | After spraying |

TABLE II-continued

| PHYSICAL PROPERTIES | | | |
|---|---|---|---|
| Property | ASTM Reference | Value | Conditions |
| Thermal Conductivity | C177 | 2.10 BTU in/ft$^2$ hr °F. | At 68° F. |
| | | 0.302 W/m °C. | At 20° C. |
| | | 1.96 BTU in/ft$^2$ hr °F. | At 154° F. |
| | | 0.283 W/m °C. | At 68° C. |
| Thermal Expansion With Mesh | D696 | $20.5 \times 10^{-6}$ in/in °F. | From −70° F. |
| | | $36.9 \times 10^{-6}$ cm/cm °C. | (−57° C.) to |
| Thermal Expansion Without Mesh | | $36.4 \times 10^{-6}$ in/in °F. | 150° F. |
| | | $65.5 \times 10^{-6}$ cm/cm °C. | (66° C.) |
| Specific Heat | Differential Scanning Calorimetry | 0.33 BTU/lbm °F. | At 86° F. |
| | | 1.38 J/Kg °C. | At 30° C. |
| | | 0.23 BTU/lbm °F. | At 500° F. |
| | | 0.96 J/Kg °C. | At 260° C. |
| Oxygen Index | D2863 | 32 | |
| Flash Point | D92 | | |
| Component I | | Over 200° F. (93° C.) | Open cup |
| Component II | | Over 200° F. (93° C.) | Open cup |
| Viscosity | | | |
| Component I | | 285000 CPS | At 100° F. (37.8° C.) |
| Component II | | 60000 CPS | At 100° F. (37.8° C.) |
| Gas (Nitrogen) Permeability | D1434 | $1.6 \times 10^{-9} \frac{\text{in}^3\ (\text{STP})\ \text{in}}{\text{sec. in}^2\ \text{Atm}}$ | At 68° F., 1.51 Atm |
| | | $1.36 \times 10^{-10} \frac{\text{cm}^3\ (\text{STP})\ \text{cm}}{\text{sec. cm}^2 \cdot \text{cmHg}}$ | At 20° C., 1.53 Bar |
| Water Vapor Transmittance | E96 Procedure B | $1.013 \times 10^{-3}$ gr/hr ft$^2$ | At 73° F. (22.8° C.) |
| | | $4.07 \times 10^{-1}$ g/hr m$^2$ | and 50% RH |
| Pot Life | | 55 minutes | At 70° F. (21° C.) |
| Gel Time | | 8 hours | At 60° F. (16° C.) |
| | | 4 hours | At 80° F. (27° C.) |
| Cure Time to Shore A of 85 | | 18 hours | At 60° F. (16° C.) |
| | | 8 hours | At 80° F. (27° C.) |
| Color | | Grey | |
| Maximum Service Temperature | | 150° F. (66° C.) | Continuous Use |

FIG. 6 shows a fireproof material coated tank, stub pipes, and supports, installed at a work site, in a basin 70 supported on the ground 71. The basin forms a collection zone 73 beneath the tank to collect any possible leakage of flammable liquid. A hood 76 may be provided over the tank and basin to prevent rainwater accumulation in the basin.

FIGS. 8 and 9 show a multiple wall tank assembly 310 having steel wall means defining a inner tank 311, intermediate tank 314, and outer tank 316. Tanks 311 and 314 are cylindrical and horizontally elongated, having a common axis 320. They have concentric side walls 311*a* and 314*a*, parallel vertical end walls 311*b* and 314*b* at one end, and parallel vertical end walls 311*c* and 314*c* at their opposite ends. The two tanks 311 and 314 are spaced apart at 315*a*, 315*b* and 315*c*. Metal struts 321 in lower extent of space 315*a* support the inner tank and its contents on the side wall 314*a* of the intermediate tank.

The outer tank 316 is rectangular, not cylindrical, but is horizontally elongated in the direction of axis 320. It has a bottom steel wall 316*a*, elongated upright side walls 316*b* and 316*c*, upright ends walls 316*id* and 316*e*, and top wall 316*f* is tapered from level 316*g* to level 316*h*. The double cylindrical walled tank structure 311 and 314, and the outer tank 316, serve the same purposes and functions, as referenced above, i.e., protection of hydrocarbon in space 312; however, the two cylindrical tanks 311 and 314 are assembled as a unit into outer tank 316, as by lowering onto a saddle 324 formed as by thermal barrier material 370 previously filled into the outer tank, cured, and forming a concave upper surface 370*a* to match the convex curvature of diameter D, of tank wall 314*a*. See FIG. 9. Subsequently, thermal barrier material is filled into space 317 between tanks 314 and 316 to fill that space at the sides and top of tank 314. Such added thermal barrier material is indicated at 371 in FIGS. 8 and 9. At the top of tank 314 the thermal barrier material is thickened due to top wall taper at 316*f*. Fire-resistant material may be added in one or more layers as at 350*a* and 350*b*, and may be added as a layer 350*c* on tank 314.

Equipment located at the top of the tank assembly is as shown, and includes primary tank work pent 380 and elongated duct 380*a* connecting to 383 secondary tank work vent 381 with duct 381*a*
tank gauge unit 382 accessing inner space 312, via duct 382*a*
vapor recovery duct 383 accessing space 312, via duct 383*a*
fluid product fill duct 384 accessing 312
fluid product spill drain duct 385
fluid spill container 386 associated with 385
product dispenser 387, and associated suction line 388 and vapor return duct 389; see also pipe 387*a* through tank walls, and pipe 377*a'*
monitor port 390 via which fluid leaking into open (unfilled) space 315 may be monitored, i.e., detected, as by a sensor 363
a liquid product return line 381*b*.
Outer tank supports appear at 399.

Space 315 in FIG. 8 may contain, or be filled, with a non-oxidizable inert gas, such as $N_2$ for enhanced protection in case of leakage of hydrocarbon into the space. Also, the space 317 may contain a barrier layer, such as silica, adjacent side walls of outer tank 316, and which does not foam or bubble when heated to 1,200° F., for example. The assembly, as described, provides protection for the hydrocarbon contents such that up to 2,000° F. flame applied for a considerable period of time (1 to 2 hours) to the fire resistant outer shell 300 on the assembly will not result in heating of the hydrocarbon contents in space 312 (or space 212 in FIG. 1) above about 10% of ambient temperature.

Elongated duct 380*a* is usable as an additional reservoir for heat expanded tank (in space 302) if needed.

The thermal barrier material in space 317 may for example consist of vermiculite; and the thermal barrier layers at 350*a*, 350*b*, and 350*c* may consist essentially of a mixture of vermiculite and Portland cement, initially applied in aqueous slurry form, and optionally sprayed on, the applied wet mix then curing in situ, on the tank wall or walls. It may be applied to one or both tanks 314 and 316 to completely cover same. Vermiculite is applied to fill the space between tanks 314 and 316 if neither tank 314 and 316 has fire resistant coating thereon, and may or may not be applied to fill the space between tanks 314 and 316 if the fire resistant coating is applied to one or both tanks. See also FIG. 10.

The fire resistant material to form coatings 350*a*, 350*b* and/or 350*c* is in the following proportions of vermiculite and Portland cement:

about 80 weight percent cement
about 20 weight percent vermiculite.

The cement component provides a completely fire resistant shell or shells, and does not add unduly to overall weight since the shell (coating) thickness is between ¼ and 1 inch, and the shell is only about 80% cement. The much greater thickness space between the two tanks 314 and 316 is typically filled with vermiculite, which is relatively lightweight and fire resistant.

The double-walled, cylindrical tank structure can also be fabricated as a single wall tank, in which case the walls 314 and 311 become unitary, as for example wall 314' in FIG. 10. The coating 350*a* may consist of an inner layer, intermediate wire mesh, and an outer layer, with total thickness of about one inch.

I claim:

1. In fire resistant tank apparatus adapted for transportation and for installation above-ground to receive and dispense a liquid hydrocarbon or hydrocarbons, or the like, the combination comprising a) a metallic tank having lightweight wall means including an upright side wall or walls, a top wall and bottom wall,
b) first means on said apparatus defining access porting to the tank interior,
c) second means beneath said bottom wall to support the tank at an installation site,
d) and fire resistant material consisting essentially of a mixture of vermiculite and Portland cement applied as a coating to the outer side or sides of said tank walls, and hardened in situ to define a relatively lightweight shell enclosing said tank,
e) the shell having thickness between about ¼ inch and 1 inch.

2. The combination of claim 1 wherein said fire resistant material is in the following proportions of vermiculite and cement:

about 80 weight percent cement
about 20 weight percent vermiculite.

3. The combination of claim 1 wherein said shell comprises:

a) a first sub-shell extending into contact with said tank walls, and hardened in situ, the first sub-shell having an outer surface, and
b) a second sub-shell extending into contact with said first sub-shell outer surface and hardened in situ.

4. The combination of claim 3 wherein the shell also includes at least one additional sub-shell hardened in situ about the outer surface of the next sub-shell closer to the tank walls.

5. The combination of claim 1 including a wire mesh embedding the shell.

6. The combination of claim 1 wherein the tank walls include inner and outer sub-walls defining a gap therebetween, and including a fire resistant material substantially filling said gap.

7. The combination of claim 6 wherein said fire resistant material in the gap consists essentially of vermiculite.

8. The combination of claim 6 wherein the tank inner wall is substantially cylindrical.

9. The combination of claim 1 wherein said first means includes at least on upright pipe stub via which access may be gained to the tank interior, the pipe stub connected to the top wall, and said shell extending adjacent to and about the pipe stub.

10. The combination of claim 1 wherein said second means comprises tank support means projecting downwardly from said bottom wall, and having sides, the shell extending adjacent to said sides.

11. The combination of claim 1 wherein the tank side wall means consists of steel and has about 10 gauge thickness.

12. The combination of claim 1 wherein the tank walls include inner and outer tanks defining a gap therebetween, and wherein said fire resistant material is applied to both said inner and outer tank walls

13. In fire resistant tank apparatus adapted for transportation and for installation above-ground to receive and dispense a liquid hydrocarbon or hydrocarbons, or the like, the combination comprising a) a metallic tank means having lightweight wall means including an upright side wall or walls, a top wall and bottom wall,
b) first means on the top wall defining access porting to the tank interior,
c) second means beneath said bottom wall to support the tank means at an installation site, d) said wall means including inner and outer tank walls defining a gap therebetween, the outer tank enclosing the inner tank;

e) and fire resistant material consisting essentially of a mixture of vermiculite and Portland cement filled into said gap to substantially fill said gap and hardened in situ to define a relatively lightweight shell enclosing said inner tank, f) the shell having thickness of at least about ¼inch.

14. The combination of claim 12 wherein said fire resistant material consists essentially of an aqueous admixture of vermiculite and Portland cement.

15. The combination of claim 13 wherein said mixture is applied per one of the following:

i) to the inner tank walls ii) to the outer tank walls iii) to both the inner and outer tank walls.

16. The combination of claim 13 including vermiculite filling said gap, above, below and at the sides of said inner tank.

17. The combination of claim 14 including vermiculite filling said gap, above, below and at the sides of said inner tank.

18. In the method of providing fire resistant tank apparatus adapted for transportation and installation above ground to receive and dispense a liquid hydrocarbon or hydrocarbons, or the like, the steps that include:

a) providing a metallic tank having lightweight upright side wall means, a top wall and a bottom wall, b) providing first means on the top wall defining access porting to the tank interior, c) providing second means beneath said bottom wall to support the tank at an installation site, d) applying fire resistant material onto the tank walls, and allowing the said material to harden in situ to form a relatively lightweight shell enclosing the tank, said material applied closely adjacent said first and second means, said material consisting essentially of an aqueous admixture of Portland cement and vermiculite in as-applied state, e) said application step continued to provide shell thickness between about ¼ and 1 inch.

19. The method of claim 17 wherein said application includes spraying which is carried out:

i) to form a first layer of material extending adjacent exterior sides of the tank walls, the first layer allowed to harden, the first layer having an outer surface;

ii) and subsequently to form a second layer extending into contact with said outer surface of the first layer, the second layer then allowed to harden.

20. The method of claim 17 wherein said material consists, in its cement-vermiculite contents, of about 80% cement about 20% vermiculite.

21. The method of claim 17 including constructing the tank walls to have inner and outer sub-walls defining a gap therebetween, and including applying said material to one of:

the inner wall the outer wall both inner and outer walls.

22. The method of claim 20 including filling vermiculite into said gap.

23. The combination of claim 1 including a collection basin underlying the tank to collect any liquid hydrocarbon leakage therefrom.

24. The combination of claim 22 including a hood overlying the tank and basin to prevent rainwater accumulation in the basin.

25. In fire resistant tank apparatus adapted for transportation and for installation above-ground to receive and dispense a liquid hydrocarbon or hydrocarbons, or the like, the combination comprising a) a metallic tank having lightweight wall means including an upright side wall or walls, a top wall and bottom wall, b) first means on the top wall defining access porting to the tank interior, c) second means projecting beneath said bottom wall to support the tank at an above-ground installation site, d) and fire resistant material applied as a coating to the outer side or sides of said tank walls, and hardened in situ to define a relatively lightweight shell enclosing said tank, the shell extending into adjacency with said first and second means, e) the shell having thickness between about ¼ inch and 1 inch, f) said fire resistant material being characterized as resisting decomposition in response to flame impingement thereon, g) the tank walls having thickness between about ¼ inch and 1 inch, h) said fire resistant material being free of retention to said tank by metallic bands with clips.

26. The combination of claim 25 including a wire mesh embedding the shell, said mesh spaced from and between an exterior surface defined by the shell and said outer side or sides of the tank walls.

27. The combination of claim 2 wherein said first means includes at least on upright pipe stub via which access may be gained to the tank interior, the pipe stub connected to the top wall, and said shell extending protectively adjacent to and about the pipe stub.

28. The combination of claim 25 wherein said second means comprises tank supports projecting downwardly from said bottom wall, and having sides, the shell extending protectively adjacent to said sides.

29. The combination of claim 25 wherein the tank walls include inner and outer sub-walls defining a gap therebetween, and wherein fire resistant material substantially fills said gap.

30. In fire resistant tank apparatus adapted for transportation and for installation above-ground to receive and dispense a liquid hydrocarbon or hydrocarbons, or the like, the combination comprising a) a steel tank having lightweight wall means including an upright side wall or walls, a top wall and bottom wall, b) first means on the top wall defining access porting to the tank interior, c) second means projecting beneath said bottom wall to support the tank at an above-ground installation site, d) said wall means including inner and outer sub-walls defining a gap therebetween, e) and fire resistant material applied to said wall means and located in said gap to effectively define a shell enclosing said inner sub-wall, f) the shell having thickness between about ¼ inch and 1 inch, g) the tank walls having thickness between about ¼ inch and 1 inch.

31. In fire resistant tank apparatus adapted for transportation and for installation above-ground to receive and dispense a liquid hydrocarbon or hydrocarbons, or the like, the combination comprising a) a steel tank having lightweight wall means including an upright side wall or walls, a top wall and bottom wall, b) first means on the top wall defining access porting to the tank interior, c) second means projecting beneath said bottom wall to support the tank at an above-ground installation site, d) and fire resistant material applied as a spray coating to the outer side or sides of said tank walls, and hardened in situ to define a relatively lightweight shell enclosing said tank, the shell extending into adjacency with said first and second means, e) said material being in place but heat degraded, after exposure to high intensity flames, f) the tank walls having thickness between about ¼ inch and about 1 inch.

32. In fire resistant tank apparatus adapted for transportation and for installation above-ground to receive and dispense a liquid hydrocarbon or hydrocarbons, or the like, the combination comprising a) a steel tank structure having lightweight wall means including inner and outer side walls, at least one top wall and at least one bottom wall, said inner wall and a bottom wall and a top wall defining a receptacle for said liquid, b) first means on the top wall defining access porting to the tank structure interior, c) second means beneath said bottom wall to support the tank structure at an installation site, d) said inner and outer side walls defining a gap therebetween, e) and heat resistant material located in said gap to effectively enclose said receptacle, f) the tank walls having thickness of at least about ¼ inch, g) and fire resistant material including vermiculite filled into said gap and hardened in situ therein, to form a protective shell about the receptacle.

33. The combination of claim 1 wherein said tank apparatus is supported above ground by said second means which comprises supports projecting downwardly beneath said bottom wall, said supports having side surfaces, and said fire resistant material substantially completely coats said side surfaces.

34. The combination of claim 32 wherein said receptacle is cylindrical and horizontally elongated, and said outer side walls extend generally vertically.

35. The combination of claim 34 wherein said heat resistant material includes at least one of the following:

i) vermiculite substantially filling said gap, above, below and at the sides of the receptacle, ii) a hardened mixture of Portland cement and vermiculite in a layer adherent to the outer side of the receptacle, iii) a hardened mixture of Portland cement and vermiculite in a layer adherent to said outer side wall.

* * * * *